US008311469B2

(12) United States Patent
Yoshikawa et al.

(10) Patent No.: US 8,311,469 B2
(45) Date of Patent: Nov. 13, 2012

(54) FIXING DEVICE AND IMAGE FORMING APPARATUS INCORPORATING SAME

(75) Inventors: Masaaki Yoshikawa, Tokyo (JP); Yoshiki Yamaguchi, Sagamihara (JP); Toshihiko Shimokawa, Zama (JP); Kenji Ishii, Kawasaki (JP); Naoki Iwaya, Choufu (JP); Takahiro Imada, Yokohama (JP); Takamasa Hase, Kawasaki (JP); Tetsuo Tokuda, Kawasaki (JP); Yutaka Ikebuchi, Chigasaki (JP); Hiroshi Yoshinaga, Ichikawa (JP); Ippei Fujimoto, Ebina (JP); Kenichi Hasegawa, Atsugi (JP); Shuntaroh Tamaki, Kawasaki (JP); Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 175 days.

(21) Appl. No.: 12/841,593

(22) Filed: Jul. 22, 2010

(65) Prior Publication Data

US 2011/0026988 A1 Feb. 3, 2011

(30) Foreign Application Priority Data

Jul. 29, 2009 (JP) ..... 2009-177092

(51) Int. Cl.
*G03G 15/20* (2006.01)

(52) U.S. Cl. ..... 399/329

(58) Field of Classification Search ..... 399/122, 399/329

See application file for complete search history.

(56) References Cited

U.S. PATENT DOCUMENTS

| | | | |
|---|---|---|---|
| 6,131,009 | A | 10/2000 | Hasegawa |
| 6,496,666 | B2 | 12/2002 | Hayashi et al. |
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |

(Continued)

FOREIGN PATENT DOCUMENTS

JP 2007-334205 12/2007

(Continued)

OTHER PUBLICATIONS

U.S. Appl. No. 12/685,225, filed Jan. 11, 2010, Akira Shinshi et al.

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

In a fixing device, a stationary member is provided inside a belt member and pressed against a rotary pressing member via the belt member to form a nip between the rotary pressing member and the belt member through which a recording medium bearing a toner image passes. An expandable heating member is provided inside the belt member to face an inner circumferential surface of the belt member to heat the belt member. A regulator contacts a downstream portion of the heating member provided downstream from a center of the nip in a direction of rotation of the belt member to expand the downstream portion of the heating member.

8 Claims, 7 Drawing Sheets

U.S. PATENT DOCUMENTS

| | | | |
|---|---|---|---|
| 6,937,827 | B2 | 8/2005 | Katoh et al. |
| 7,022,944 | B2 | 4/2006 | Yoshinaga et al. |
| 7,070,182 | B2 | 7/2006 | Hasegawa |
| 7,127,204 | B2 | 10/2006 | Satoh et al. |
| 7,151,907 | B2 | 12/2006 | Yoshinaga |
| 7,239,838 | B2 | 7/2007 | Sato et al. |
| 7,242,897 | B2 | 7/2007 | Satoh et al. |
| 7,313,353 | B2 | 12/2007 | Satoh et al. |
| 7,330,682 | B2 | 2/2008 | Shinshi |
| 7,379,698 | B2 | 5/2008 | Yoshinaga |
| 7,437,111 | B2 | 10/2008 | Yamada et al. |
| 7,454,151 | B2 | 11/2008 | Satoh et al. |
| 7,466,949 | B2 | 12/2008 | Satoh et al. |
| 7,509,085 | B2 | 3/2009 | Yoshinaga et al. |
| 7,515,850 | B2 | 4/2009 | Hasegawa |
| 7,546,049 | B2 | 6/2009 | Ehara et al. |
| 7,570,910 | B2 | 8/2009 | Ishii |
| 7,593,680 | B2 | 9/2009 | Shinshi |
| 7,630,652 | B2 | 12/2009 | Hasegawa |
| 7,702,271 | B2 | 4/2010 | Yamada et al. |
| 7,742,714 | B2 | 6/2010 | Shinshi et al. |
| 2006/0029411 | A1 | 2/2006 | Ishii et al. |
| 2006/0257183 | A1 | 11/2006 | Ehara et al. |
| 2007/0003334 | A1 | 1/2007 | Shinshi et al. |
| 2007/0014600 | A1 | 1/2007 | Ishii et al. |
| 2007/0059071 | A1 | 3/2007 | Shinshi et al. |
| 2007/0292175 | A1 | 12/2007 | Shinshi |
| 2008/0063443 | A1 | 3/2008 | Yoshinaga et al. |
| 2008/0112739 | A1 | 5/2008 | Shinshi |
| 2008/0175633 | A1 | 7/2008 | Shinshi |
| 2008/0219721 | A1 | 9/2008 | Ito et al. |
| 2008/0219730 | A1 | 9/2008 | Shinshi |
| 2008/0226326 | A1 | 9/2008 | Seo et al. |
| 2008/0232873 | A1 | 9/2008 | Ueno et al. |
| 2008/0253788 | A1 | 10/2008 | Shinshi |
| 2008/0253789 | A1 | 10/2008 | Yoshinaga et al. |
| 2008/0298862 | A1 * | 12/2008 | Shinshi ..... 399/324 |
| 2008/0317532 | A1 | 12/2008 | Ehara et al. |
| 2009/0003867 | A1 | 1/2009 | Fujimoto |
| 2009/0067902 | A1 | 3/2009 | Yoshinaga et al. |
| 2010/0061753 | A1 | 3/2009 | Hase |
| 2009/0123201 | A1 | 5/2009 | Ehara et al. |
| 2009/0123202 | A1 | 5/2009 | Yoshinaga et al. |
| 2009/0148204 | A1 | 6/2009 | Yoshinaga et al. |
| 2009/0148205 | A1 | 6/2009 | Seo et al. |
| 2009/0169232 | A1 | 7/2009 | Kunii et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2009/0311016 | A1 | 12/2009 | Shinshi |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |

FOREIGN PATENT DOCUMENTS

| | | |
|---|---|---|
| JP | 2008-158482 | 7/2008 |
| JP | 2009-3410 | 1/2009 |

* cited by examiner

FIXING DEVICE AND IMAGE FORMING APPARATUS INCORPORATING SAME

CROSS-REFERENCE TO RELATED APPLICATION

The present application is based on and claims priority to Japanese Patent Application No. 2009-177092, filed on Jul. 29, 2009, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a pipe-shaped heating member to heat the fixing device effectively to shorten a warm-up time or a time to first print (hereinafter also "first print time"). Specifically, the heating member provided inside a loop formed by an endless belt member and facing the inner circumferential surface of the belt member is heated by an internal heater so as to heat the belt member. A stationary member is provided inside the loop formed by the belt member and presses against a rotary pressing member via the belt member to form a nip between the belt member and the rotary pressing member through which the recording medium bearing the toner image passes. The belt member and the rotary pressing member apply heat and pressure to the recording medium to fix the toner image on the recording medium.

The pipe-shaped heating member may be manufactured by bending a metal plate into a C-like shape in cross-section, so that an opening is extended in the long direction of the heating member perpendicular to the direction of rotation of the belt member. However, given such a shape, the inherent spring-back of the metal plate of the heating member, which attempts to return the heating member to its original shape after compression, may enlarge the opening in the heating member. Accordingly, the outer circumference of the heating member may be enlarged irregularly and may contact the inner circumferential surface of the belt member. Consequently, the belt member may be unevenly heated by the heating member, resulting in uneven fixing of the toner image on the recording medium.

To address this problem, the ends of the metal plate may be welded together to form an endless heating member without an opening. However, when the outer circumference of the heating member is substantially smaller than the inner circumference of the belt member, the heating member may not heat the belt member effectively. By contrast, when the outer circumference of the heating member is substantially greater than the inner circumference of the belt member, the heating member may not be installed inside the belt member easily.

Further, the belt member is tensioned by a greater force upstream from the nip in the direction of rotation of the belt member compared to downstream from the nip. Accordingly, the belt member may slacken downstream from the nip, enlarging the gap between the heating member and the belt member. Consequently, the heating member may not heat the belt member effectively. Moreover, the slacked belt member may disturb movement of the recording medium discharged from the nip, preventing smooth conveyance of the recording medium and creasing or wrinkling the recording medium.

BRIEF SUMMARY OF THE INVENTION

This specification describes below a fixing device according to exemplary embodiments of the present invention. In one exemplary embodiment of the present invention, the fixing device includes a flexible endless belt member, a rotary pressing member, a stationary member, an expandable heating member, and a regulator. The belt member rotates in a predetermined direction of rotation. The rotary pressing member is disposed opposite the belt member. The stationary member is provided inside a loop formed by the belt member and pressed against the rotary pressing member via the belt member to form a nip between the rotary pressing member and the belt member through which a recording medium bearing a toner image passes. The heating member is provided inside the loop formed by the belt member to face an inner circumferential surface of the belt member to heat the belt member. The heating member includes an upstream portion provided upstream from a center of the nip in the direction of rotation of the belt member and a downstream portion provided downstream from the center of the nip in the direction of rotation of the belt member. The regulator regulates expansion of the heating member. The regulator contacts the downstream portion of the heating member to expand the downstream portion of the heating member.

This specification describes below an image forming apparatus according to exemplary embodiments of the present invention. In one exemplary embodiment of the present invention, the image forming apparatus includes the fixing device described above.

This specification describes below a fixing device according to exemplary embodiments of the present invention. In one exemplary embodiment of the present invention, the fixing device includes rotating means, rotary pressing means, stationary pressing means, expandable heating means, and regulating means. The rotating means rotates in a predetermined direction of rotation. The rotary pressing means rotatively presses against the rotating means. The stationary pressing means presses against the rotary pressing means via the rotating means to form a nip between the rotary pressing means and the rotating means through which a recording medium bearing a toner image passes. The expandable heating means heats the rotating means, and includes an upstream portion provided upstream from a center of the nip in the direction of rotation of the rotating means and a downstream portion provided downstream from the center of the nip in the direction of rotation of the rotating means. The regulating means regulates expansion of the heating means to expand the downstream portion of the heating means by contacting the downstream portion of the heating means.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
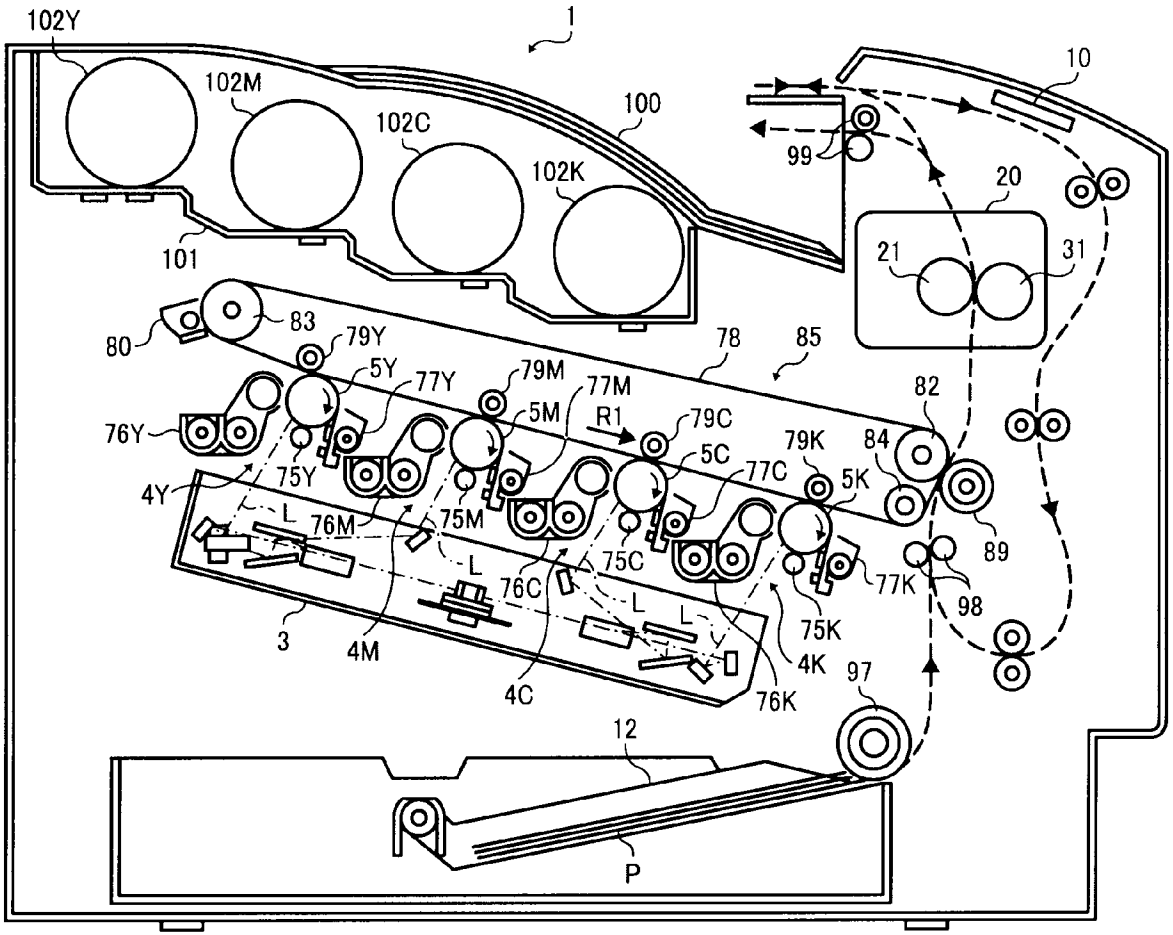
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form electrostatic latent images corresponding to yellow, magenta, cyan, and black colors, respectively.

In the development process, the development devices 76Y, 76M, 76C, and 76K make the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively. Thus, a series of image forming processes performed on the photoconductive drums 5Y, 5M, 5C, and 5K is finished.

The intermediate transfer belt 78 is supported by and looped over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, the color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97. For example, the roller nip of the registration roller pair 98 contacts and stops a leading edge of the recording medium P. The registration roller pair 98 resumes rotating to feed the recording medium P to a second transfer nip formed between the second transfer roller 89 and the intermediate transfer belt 78 at a time at which the color toner image formed on the intermediate transfer belt 78 reaches the second transfer nip.

At the second transfer nip, the second transfer roller 89 and the second transfer backup roller 82 sandwich the intermediate transfer belt 78. The second transfer roller 89 transfers the color toner image formed on the intermediate transfer belt 78 onto the recording medium P fed by the registration roller pair 98 at the second transfer nip formed between the second transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78.

Thus, a series of transfer processes performed on the intermediate transfer belt 78 is finished.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively. Accordingly, a series of image forming processes performed by the image forming apparatus 1 is finished.

The controller 10 controls operations of the image forming apparatus 1.

Referring to FIGS. 2 to 8B, the following describes the structure and operations of the fixing device 20.

Figure 2:
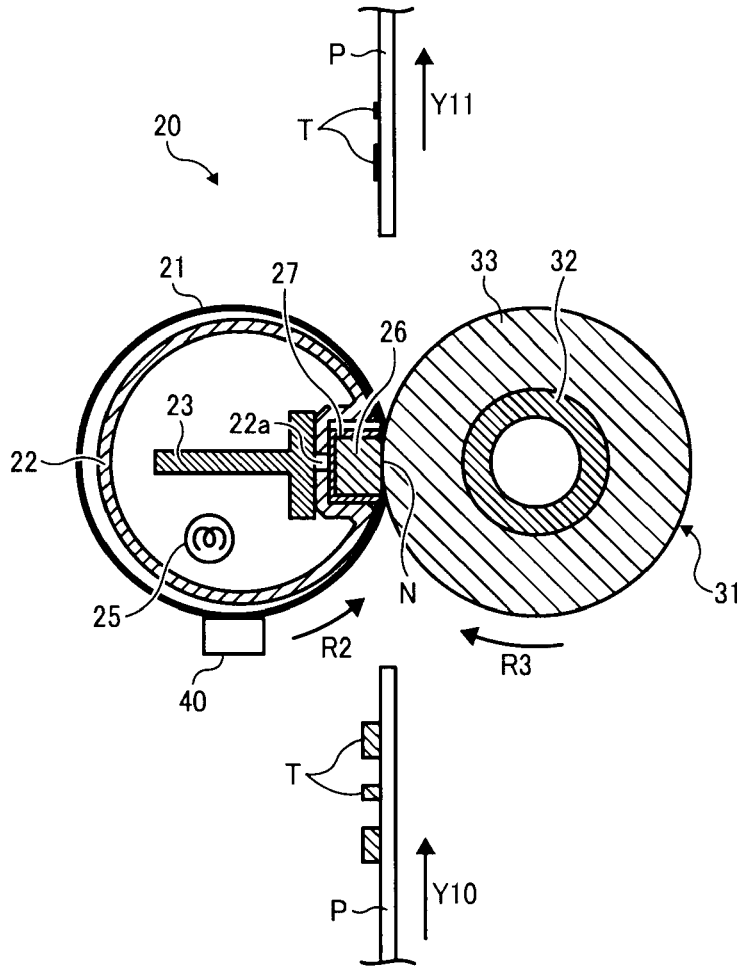
FIG. 2 is a schematic view of a fixing device included in the image forming apparatus shown in FIG. 1.

FIG. 2 is a schematic view of the fixing device 20. As illustrated in FIG. 2, the fixing device 20 further includes a heating member 22, a reinforcement member 23, a heater 25, a stationary member 26, a heat insulator 27, and a temperature sensor 40. The heating member 22 includes an opening 22*a*. The pressing roller 31 includes a metal core 32 and an elastic layer 33.

Figure 3:
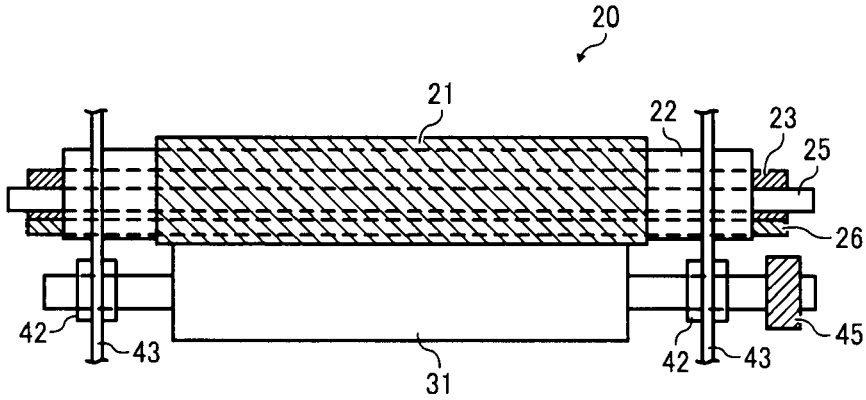
FIG. 3 is a plan view of the fixing device shown in FIG. 2.

FIG. 3 is a plan view of the fixing device 20. As illustrated in FIG. 3, the fixing device 20 further includes bearings 42, side plates 43, and a gear 45.

Figure 4:
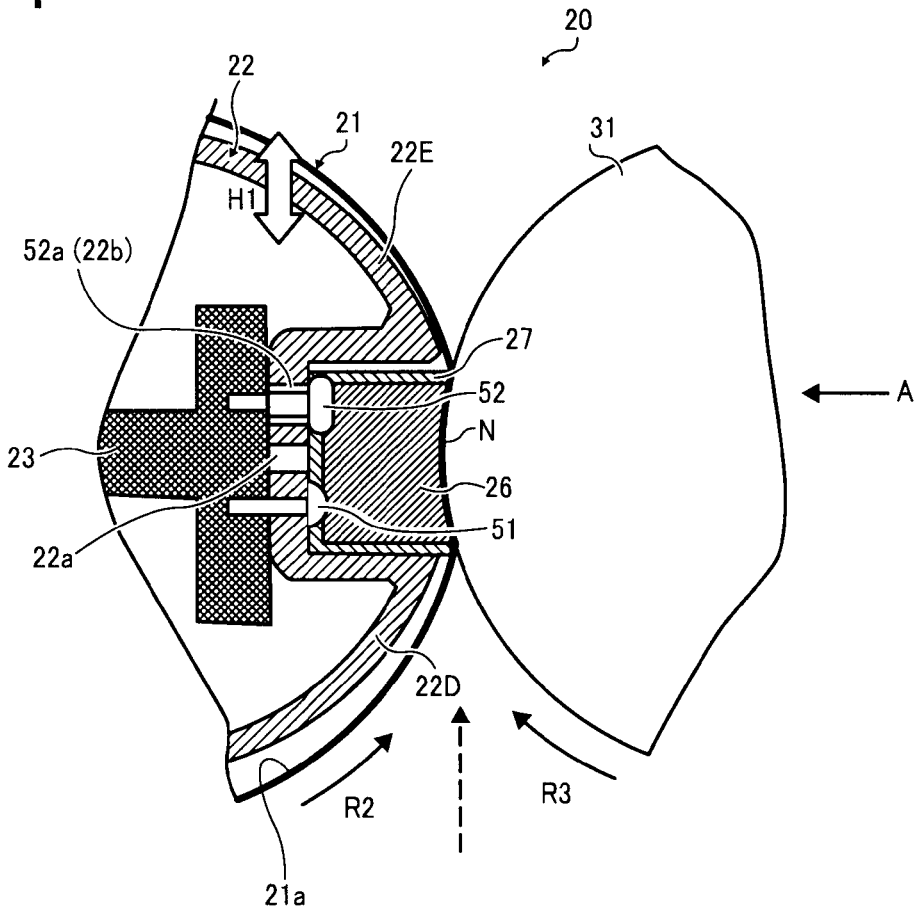
FIG. 4 is a partially enlarged view of the fixing device shown in FIG. 2.

FIG. 4 is a partially enlarged view of the fixing device 20. As illustrated in FIG. 4, the fixing device 20 further includes a screw 51 and a collar screw 52. The collar screw 52 includes a collar 52*a*. The fixing belt 21 includes an inner surface layer 21*a*. The heating member 22 includes a fixed end 22D and a free end 22E. The free end 22E includes an elongated through-hole 22*b*.

Figure 5:
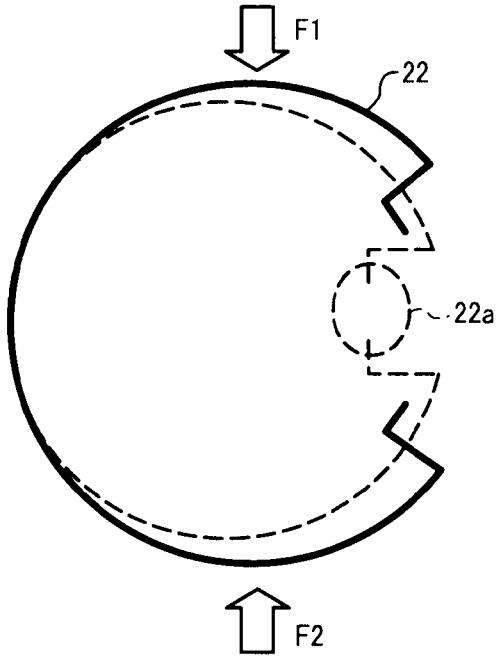
FIG. 5 is a schematic view of a heating member included in the fixing device shown in FIG. 4 when the heating member is not installed in the fixing device.

FIG. 5 is a schematic view of the heating member 22 when the heating member 22 is not installed in the fixing device 20.

Figure 6A:
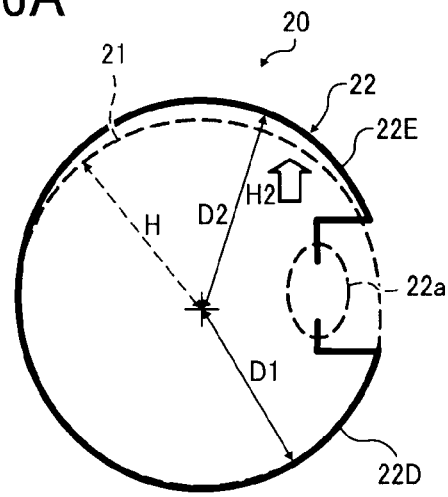
FIG. 6A is a side view of the heating member shown in FIG. 5 when an external force is not applied to the heating member.
Figure 6B:
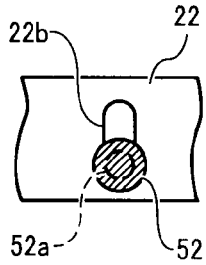
FIG. 6B is a front view of the heating member shown in FIG. 6A.

FIG. 6A is a side view of the heating member 22 reinforced by the reinforcement member 23 when an external force is not applied to the heating member 22. FIG. 6B is a front view of the heating member 22 and the collar screw 52 when the external force is not applied to the heating member 22.

Figure 7A:
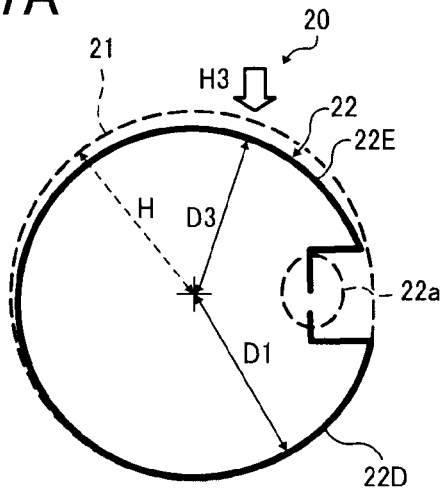
FIG. 7A is a side view of the heating member shown in FIG. 5 during installation of the heating member inside the fixing device shown in FIG. 4.
Figure 7B:
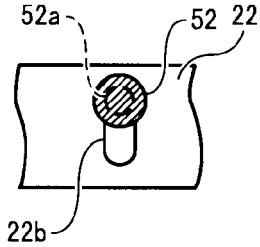
FIG. 7B is a front view of the heating member shown in FIG. 7A.

FIG. 7A is a side view of the heating member 22 reinforced by the reinforcement member 23 during installation of the heating member 22 inside the fixing belt 21. FIG. 7B is a front view of the heating member 22 and the collar screw 52 during installation of the heating member 22 inside the fixing belt 21.

Figure 8A:
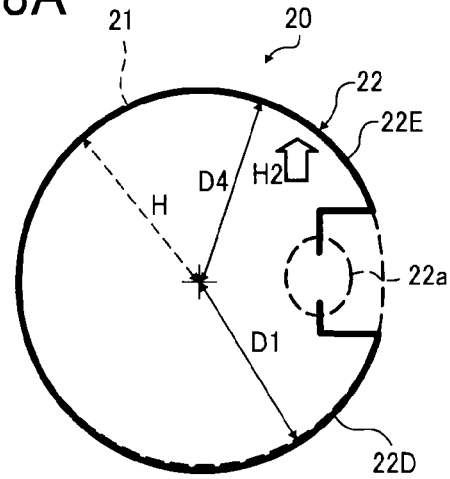
FIG. 8A is a side view of the heating member shown in FIG. 5 when installation of the heating member inside the fixing device shown in FIG. 4 is finished.
Figure 8B:
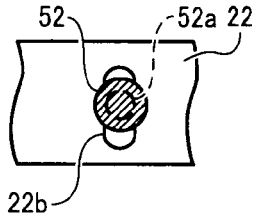
FIG. 8B is a front view of the heating member shown in FIG. 8A.

FIG. 8A is a side view of the heating member 22 reinforced by the reinforcement member 23 when installation of the heating member 22 inside the fixing belt 21 is finished. FIG. 8B is a front view of the heating member 22 and the collar screw 52 when installation of the heating member 22 inside the fixing belt 21 is finished.

As illustrated in FIG. 2, the fixing device 20 includes the fixing belt 21 serving as a belt member, the stationary member 26, the heating member 22, the reinforcement member 23 serving as a holding member or a regulator, the heat insulator 27, the heater 25 serving as a heater or a heat source, the pressing roller 31 serving as a rotary pressing member, and the temperature sensor 40.

The fixing belt 21 serving as a belt member may be a thin, flexible endless belt that rotates or moves counterclockwise in FIG. 2 in a rotation direction R2. The fixing belt 21 includes the inner surface layer 21*a* depicted in FIG. 4, a base layer, an elastic layer, and a releasing layer, and has a total thickness not greater than about 1 mm. The inner surface layer 21*a* serves as a sliding surface portion which slides over the stationary member 26. The base layer is provided on the inner surface layer 21*a*. The elastic layer is provided on the base layer. The releasing layer is provided on the elastic layer.

The inner surface layer 21*a*, that is, an inner circumferential surface of the fixing belt 21, has a layer thickness not greater than about 50 μm, and includes a material containing fluorine. For example, the inner surface layer 21*a* may include a fluoroplastic material such as tetrafluoroethylene-perfluoroalkylvinylether copolymer (PFA), polytetrafluoroethylene (PTFE), and/or tetrafluoroethylene-hexafluoropropylene copolymer (FEP), and/or a material containing the above fluoroplastic mixed with resin such as polyimide, polyamide, and/or polyamideimide.

The base layer of the fixing belt 21 has a layer thickness in a range of from about 30 μm to about 50 μm, and includes a metal material such as nickel and/or stainless steel, and/or a resin material such as polyimide.

The elastic layer of the fixing belt 21 has a layer thickness in a range of from about 100 μm to about 300 μm, and includes a rubber material such as silicon rubber, silicon rubber foam, and/or fluorocarbon rubber. The elastic layer prevents or reduces slight surface asperities of the fixing belt 21 generating at a nip N formed between the fixing belt 21 and the pressing roller 31. Accordingly, heat is uniformly transmitted from the fixing belt 21 to a toner image T on a recording medium P, suppressing formation of a rough image such as an orange peel image.

The releasing layer of the fixing belt 21 has a layer thickness in a range of from about 10 μm to about 50 μm, and includes PFA, PTFE, polyimide, polyetherimide, and/or polyether sulfide (PES). The releasing layer releases or separates the toner image T from the fixing belt 21.

The fixing belt 21 has a diameter in a range of from about 15 mm to about 120 mm. According to this exemplary embodiment, the fixing belt 21 has a diameter of about 30 mm.

As illustrated in FIGS. 2 and 4, the stationary member 26, the heater 25, the heating member 22, the reinforcement member 23, and the heat insulator 27 are fixedly provided inside a loop formed by the fixing belt 21. In other words, the stationary member 26, the heater 25, the heating member 22, the reinforcement member 23, and the heat insulator 27 do not face an outer circumferential surface of the fixing belt 21, but face the inner circumferential surface of the fixing belt 21.

The stationary member 26 includes a rigid portion including metal, an elastic portion including rubber, and a lubrication sheet covering the rigid portion and the elastic portion. The rigid portion of the stationary member 26 contacts the reinforcement member 23 via the opening 22*a* of the heating member 22. The rigid portion of the stationary member 26 includes a rigid material (e.g., a highly rigid metal or ceramic) so that the stationary member 26 is not bent substantially by pressure applied by the pressing roller 31. A surface portion of the elastic portion which faces the pressing roller 31 has a concave shape corresponding to a curvature of the pressing roller 31. Accordingly, the recording medium P moves along the concave surface portion of the elastic portion of the stationary member 26 corresponding to the curvature of the pressing roller 31, and is discharged from the nip N. Consequently, the recording medium P bearing the fixed toner image T is not adhered to the fixing belt 21, and separates from the fixing belt 21.

According to this exemplary embodiment, the stationary member 26 has the concave shape to form the concave nip N. Alternatively, the stationary member 26 may have a planar shape to form the planer nip N. Specifically, a sliding surface portion of the stationary member 26 which faces the pressing roller 31 may have the planar shape. Accordingly, the planer nip N formed by the planar sliding surface portion of the stationary member 26 is substantially parallel to an image side of the recording medium P. Consequently, the fixing belt 21 pressed by the planar sliding surface portion of the stationary member 26 is adhered to the recording medium P precisely to improve fixing property. Further, an increased curvature of the fixing belt 21 at an exit of the nip N separates the recording medium P discharged from the nip N from the fixing belt 21 easily.

The lubrication sheet impregnated with a lubricant such as fluorine grease serves as an outer circumferential surface portion of the stationary member 26 to reduce sliding resistance between the stationary member 26 and the fixing belt 21.

According to this exemplary embodiment, the heat insulator 27 is provided between the stationary member 26 and the heating member 22 to insulate the stationary member 26 from the heater 25. In other words, the fixing belt 21 is heated with a reduced amount of heat at the nip N. Accordingly, a temperature of the recording medium P discharged from the nip N is smaller than a temperature of the recording medium P entering the nip N. Consequently, when the recording medium P bearing the fixed toner image T is discharged from the nip N, the fixed toner image T on the recording medium P has a decreased temperature, and therefore the toner has a decreased viscosity. In other words, a decreased adhesive force of the toner that adheres the fixed toner image T to the fixing belt 21 separates the recording medium P from the fixing belt 21. Accordingly, the recording medium P bearing the fixed toner image T is not wound around the fixing belt 21 immediately after the fixing process. Consequently, the fixing belt 21 does not jam the recording medium P, and the toner is not moved to the fixing belt 21 and solidified on the fixing belt 21.

As illustrated in FIGS. 2 and 4, the heating member 22 may be pipe-shaped and may have a thickness of about 0.1 mm. The heating member 22 directly faces the inner circumferential surface of the fixing belt 21 at a position other than the nip N. The heating member 22 has a concave shape at the nip N. Specifically, the heating member 22 includes a concave portion provided with the opening 22*a*. The stationary member 26 is inserted into the concave portion of the heating member 22 in such a manner that a small clearance generated by spring-back of the heating member 22 is provided between the stationary member 26 and the heating member 22. As illustrated in FIGS. 3 and 4, at a position upstream from the nip N in a recording medium conveyance direction, both ends of the heating member 22 in a width direction, that is, a long direction, of the heating member 22 parallel to an axial direction of the fixing belt 21 are fixedly supported by the side plates 43 of the fixing device 20. By contrast, at a position downstream from the nip N in the recording medium conveyance direction, both ends of the heating member 22 in the width direction of the heating member 22 are loosely supported by the side plates 43 of the fixing device 20.

The heating member 22 heated by radiation heat generated by the heater 25 heats (e.g., transmits heat to) the fixing belt 21. In other words, the heater 25 heats the heating member 22 directly and heats the fixing belt 21 indirectly via the heating member 22. The heating member 22 may include a metal thermal conductor, that is, a metal having thermal conductivity, such as stainless steel, aluminum, iron, and/or copper. The heating member 22 may be essentially a pipe, walls of which have a thickness not greater than about 0.2 mm to improve heating efficiency for heating the fixing belt 21 and the heating member 22. According to this exemplary embodiment, the heating member 22 includes stainless steel having a thickness of about 0.1 mm.

The heater 25, serving as a heater or a heat source, includes a halogen heater and/or a carbon heater. As illustrated in FIG. 3, both ends of the heater 25 in a width direction, that is, a long direction, of the heater 25 parallel to the axial direction of the fixing belt 21 are fixedly mounted on the side plates 43 of the fixing device 20. Radiation heat generated by the heater 25, which is controlled by a power source provided in the image forming apparatus 1 depicted in FIG. 1, heats the heating member 22. The heating member 22 heats a substantially whole portion of the fixing belt 21. In other words, the heating member 22 heats a portion of the fixing belt 21 other than the nip N. Heat is transmitted from the heated outer circumferential surface of the fixing belt 21 to the toner image T on the recording medium P.

As illustrated in FIG. 2, the temperature sensor 40, which may be a thermistor, is disposed opposite the outer circumferential surface of the fixing belt 21 to detect a temperature of the outer circumferential surface of the fixing belt 21. The controller 10 depicted in FIG. 1 controls the heater 25 according to detection results provided by the temperature sensor 40 so as to adjust the temperature (e.g., a fixing temperature) of the fixing belt 21 to a desired temperature.

As described above, in the fixing device 20 according to this exemplary embodiment, the heating member 22 does not heat a small part of the fixing belt 21 but heats substantially a whole region of the fixing belt 21 in a circumferential direction of the fixing belt 21. Accordingly, even when the image forming apparatus 1 depicted in FIG. 1 forms a toner image at high speed, the fixing belt 21 is heated sufficiently to suppress fixing failure. In other words, the relatively simple structure of the fixing device 20 heats the fixing belt 21 efficiently, resulting in a shortened warm-up time, a shortened first print time, and the downsized image forming apparatus 1.

A gap δ formed between the fixing belt 21 and the heating member 22 at a position other than the nip N and the free end 22E of the heating member 22, that is, a downstream portion provided downstream from a center of the nip N in the recording medium conveyance direction, may have a size greater than 0 mm and not greater than 1 mm, which is shown as $0\ \text{mm} < \delta \leqq 1\ \text{mm}$. Accordingly, the fixing belt 21 does not slidably contact the heating member 22 over an increased area, suppressing wear of the fixing belt 21. Further, a substantial clearance is not provided between the heating member 22 and the fixing belt 21, suppressing decrease in heating efficiency of the heating member 22 for heating the fixing belt 21. Moreover, the heating member 22 disposed close to the fixing belt 21 maintains the circular loop formed by the flexible fixing belt 21, decreasing degradation and damage of the fixing belt 21 due to slackening of the fixing belt 21.

As illustrated in FIG. 4, the inner surface layer 21*a* including fluorine is provided as the inner circumferential surface of the fixing belt 21, and a lubricant, such as fluorine grease, is applied between the fixing belt 21 and the heating member 22, so as to decrease wear of the fixing belt 21 even when the fixing belt 21 slidably contacts the heating member 22. Further, a slide-contact surface of the heating member 22 over which the fixing belt 21 slides may include a low friction material.

According to this exemplary embodiment, the heating member 22 has a substantially circular shape in cross-section. Alternatively, the heating member 22 may have a polygonal shape in cross-section.

As illustrated in FIG. 2, the reinforcement member 23 reinforces the stationary member 26 which forms the nip N between the fixing belt 21 and the pressing roller 31. The reinforcement member 23 is fixedly provided inside the loop formed by the fixing belt 21 and faces the inner circumferential surface of the fixing belt 21.

As illustrated in FIG. 3, a width of the reinforcement member 23 in a width direction, that is, a long direction, of the reinforcement member 23 parallel to the axial direction of the fixing belt 21, is equivalent to a width of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20 in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 may not be deformed substantially when the stationary member 26 receives pressure applied by the pressing roller 31 at the nip N.

In order to provide the above-described functions, the reinforcement member 23 may include a metal material, such as stainless steel and/or iron, providing a high mechanical strength. An opposing surface of the reinforcement member 23 opposing the heater 25 may be composed partially or wholly of a heat insulation material. Alternatively, the opposing surface of the reinforcement member 23 opposing the heater 25 may be mirror-ground. Accordingly, heat output by the heater 25 toward the reinforcement member 23 to heat the reinforcement member 23 is used to heat the heating member 22, improving heating efficiency for heating the heating member 22 and the fixing belt 21.

As illustrated in FIG. 2, the pressing roller 31 serves as a rotary pressing member for contacting the outer circumferential surface of the fixing belt 21 at the nip N. The pressing roller 31 has a diameter of about 30 mm. In the pressing roller 31, the elastic layer 33 is provided on the hollow metal core 32. The elastic layer 33 includes silicon rubber foam, silicon rubber, and/or fluorocarbon rubber. A thin releasing layer including PFA and/or PTFE may be provided on the elastic layer 33 to serve as a surface layer. The pressing roller 31 is pressed against the fixing belt 21 to form the desired nip N between the pressing roller 31 and the fixing belt 21.

As illustrated in FIG. 3, the gear 45 engaging a driving gear of a driving mechanism is mounted on the pressing roller 31 to rotate the pressing roller 31 in a rotation direction R3, which is clockwise in FIG. 2. Both ends of the pressing roller 31 in a width direction, that is, a long direction or an axial direction, of the pressing roller 31 are rotatively supported by the side plates 43 of the fixing device 20 via the bearings 42, respectively. A heat source, such as a halogen heater, may be provided inside the pressing roller 31.

When the elastic layer 33 of the pressing roller 31 includes a sponge material such as silicon rubber foam, the pressing roller 31 applies decreased pressure to the fixing belt 21 at the nip N to decrease bending of the heating member 22. Further, the pressing roller 31 provides increased heat insulation, and therefore heat is not transmitted from the fixing belt 21 to the pressing roller 31 easily, improving heating efficiency for heating the fixing belt 21.

According to this exemplary embodiment, the diameter of the fixing belt 21 is equivalent to the diameter of the pressing roller 31. Alternatively, the diameter of the fixing belt 21 may be smaller than the diameter of the pressing roller 31. In this case, a curvature of the fixing belt 21 is smaller than a curvature of the pressing roller 31 at the nip N, and therefore a recording medium P separates from the fixing belt 21 easily when the recording medium P is sent out of the nip N.

Referring to FIG. 2, the following describes operations of the fixing device 20 having the above-described structure.

When the image forming apparatus 1 depicted in FIG. 1 is powered on, power is supplied to the heater 25, and the pressing roller 31 starts rotating in the rotation direction R3. Accordingly, friction between the pressing roller 31 and the fixing belt 21 rotates the fixing belt 21 in the rotation direction R2. In other words, the fixing belt 21 is driven by the rotating pressing roller 31.

Thereafter, a recording medium P is sent from the paper tray 12 (depicted in FIG. 1) toward the second transfer roller 89 (depicted in FIG. 1) so that a color toner image (e.g., a toner image T) is transferred from the intermediate transfer belt 78 (depicted in FIG. 1) onto the recording medium P. A guide guides the recording medium P bearing the unfixed toner image T in a direction Y10 so that the recording medium P bearing the unfixed toner image T enters the nip N formed between the fixing belt 21 and the pressing roller 31 pressed against the fixing belt 21.

The fixing belt 21 heated by the heater 25 via the heating member 22 applies heat to the recording medium P bearing the unfixed toner image T. Simultaneously, the stationary member 26 reinforced by the reinforcement member 23 and the pressing roller 31 apply pressure to the recording medium P bearing the unfixed toner image T. Thus, the heat and the pressure fix the unfixed toner image T on the recording medium P. Thereafter, the recording medium P bearing the fixed toner image T is sent out of the nip N and conveyed in a direction Y11.

Referring to FIG. 5, the following describes detailed structure and operations of the fixing device 20 according to this exemplary embodiment.

When the heating member 22 is not installed in the fixing device 20, that is, when the heating member 22 is removed from the fixing device 20, an outer circumference of the heating member 22 is changeable under a predetermined condition.

Specifically, the heating member 22 includes the opening 22*a* so that the heating member 22 has a C-like shape, that is, a substantially circular shape with ends disposed opposite each other, in cross-section continuously in the width direction of the heating member 22. When an external force is applied to the heating member 22 in directions F1 and F2 in a state in which the heating member 22 is not installed in the fixing device 20, the external force elastically deforms the heating member 22 to change the outer circumference of the heating member 22, that is, to change the shape of the heating member 22 diametrically.

For example, a thin stainless steel plate is bent into the heating member 22 having the shape illustrated by broken lines in FIG. 5. In other words, the single stainless steel plate is bent to cause one end of the plate to be disposed close to another end of the plate to form the opening 22*a* between the both ends of the plate disposed opposite each other. However, when the heating member 22 is not installed in the fixing device 20, spring-back of the plate of the heating member 22 causes the outer circumference of the heating member 22 to be greater as illustrated by solid lines in FIG. 5. Accordingly, the opening 22*a* becomes greater.

The heating member 22 having the above-described structure is installed in the fixing device 20 in such a manner that the opening 22*a* of the heating member 22 faces the nip N as illustrated in FIG. 4. Specifically, the heating member 22 is installed in the fixing device 20 in such a manner that the reinforcement member 23, the screw 51, and the collar screw 52, which serve as a regulator or a holding member, hold or support the heating member 22.

Further, the reinforcement member 23, the screw 51, and the collar screw 52 regulate deformation (e.g., expansion) of the heating member 22 so that the outer circumference (e.g., an outer radius) of the free end 22E, that is, the downstream portion of the heating member 22 provided downstream from the center of the nip N in the rotation direction R2 of the fixing belt 21, is greater than the outer circumference of a portion of the heating member 22 other than the downstream portion, that is, the upstream portion of the heating member 22 provided upstream from the center of the nip N in the rotation direction R2 of the fixing belt 21.

Specifically, the reinforcement member 23, the screw 51, and the collar screw 52 hold the heating member 22 in such a manner that one end of the heating member 22, which is provided upstream from the center of the nip N in the rotation direction R2 of the fixing belt 21 and adjacent to the opening 22*a*, serves as the fixed end 22D and that another end of the heating member 22, which is provided downstream from the center of the nip N in the rotation direction R2 of the fixing belt 21 and adjacent to the opening 22*a*, serves as the free end 22E.

The fixed end 22D of the heating member 22 includes a circular through-hole into which a male screw portion of the screw 51 serving as a first fastener is inserted. The free end 22E of the heating member 22 includes the elongated through-hole 22*b* into which the collar 52*a* of the collar screw 52 serving as a second fastener is inserted. In other words, the collar 52*a* of the collar screw 52 engages the elongated through-hole 22*b* of the heating member 22 as illustrated in FIG. 8B. On the other hand, the reinforcement member 23 includes two female screw portions provided in an opposing surface portion of the reinforcement member 23 disposed opposite the stationary member 26. The screw 51 is screwed into one of the female screw portions of the reinforcement member 23, and the collar screw 52 is screwed into another one of the female screw portions of the reinforcement member 23. As illustrated in FIG. 8B, the elongated through-hole 22*b* provided in the free end 22E of the heating member 22 is elongated in a longitudinal direction corresponding to the rotation direction R2 of the fixing belt 21, that is, a vertical direction in FIG. 4. For example, the three screws 51 may be arranged in the width direction of the heating member 22 at three positions, that is, at a center portion and both end portions of the heating member 22 in the width direction of the heating member 22, respectively. Similarly, the three collar screws 52 may be arranged at the three positions, respectively. Thus, the three screws 51 fix the heating member 22 to the reinforcement member 23 and the three collar screws 52 hold the heating member 22 with respect to the reinforcement member 23.

Accordingly, the screw 51 fixes the fixed end 22D of the heating member 22 to the reinforcement member 23, and the collar screw 52 holds the free end 22E of the heating member 22 in such a manner that the free end 22E is movable in a direction H1 along the rotation direction R2 of the fixing belt 21.

With the above-described structure, spring-back of the heating member 22 deforms the free end 22E of the heating member 22 so that the free end 22E contacts the inner circumferential surface of the fixing belt 21 and corresponds to a normal shape, that is, a substantially circular shape, of the fixing belt 21. In other words, the outer circumference of the free end 22E of the heating member 22 is enlarged to be greater than the outer circumference of the fixed end 22D of the heating member 22. For example, the fixed end 22D maintains the circular shape substantially. By contrast, the free end 22E is expanded into a substantially elliptic shape. Accordingly, the fixing belt 21 is prevented from slackening at a position downstream from the center of the nip N in the rotation direction R2 of the fixing belt 21 at which the fixing belt 21 faces the downstream portion (e.g., the free end 22E) of the heating member 22. The implications of this arrangement are described below.

Figure 9:
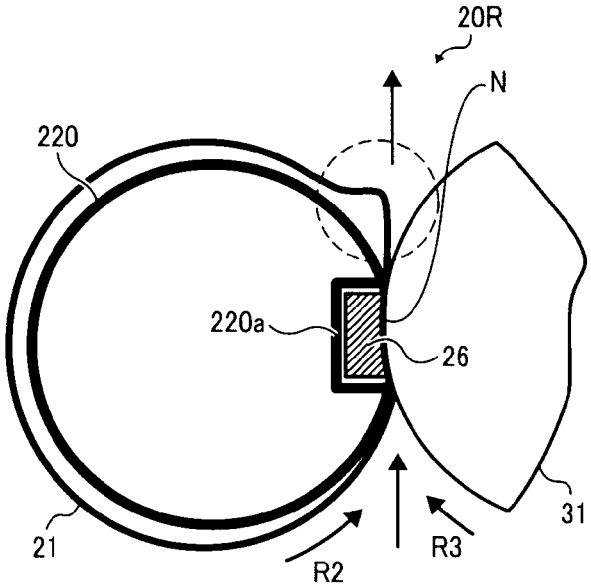
FIG. 9 is a schematic view of a comparative fixing device.

As illustrated in FIG. 9, in a comparative fixing device 20R, a connecting portion 220*a* connects one end of the heating member 220 with another end of the heating member 220. The fixing belt 21 is tensioned at an upstream position provided upstream from the center of the nip N in the rotation direction R2 of the fixing belt 21. Accordingly, the fixing belt 21 may slacken easily at a downstream position provided downstream from the center of the nip N in the rotation direction R2 of the fixing belt 21, which is indicated by broken lines in FIG. 9. When the fixing belt 21 slackens substantially at the downstream position, the fixing belt 21 is separated from the heating member 220 by a substantial distance. Accordingly, the heating member 220 may heat the fixing belt 21 with decreased heating efficiency. Moreover, the slackened fixing belt 21 may interfere with movement of a recording medium P sent out of the nip N, degrading conveyance of the recording medium P and creasing or wrinkling the recording medium P.

To address this problem, in the fixing device 20 (depicted in FIG. 4) according to this exemplary embodiment, the outer circumference of the free end 22E, that is, the downstream portion, of the heating member 22 provided at the downstream position downstream from the center of the nip N is greater than the outer circumference of a portion of the heating member 22 other than the downstream portion. Accordingly, the downstream portion of the fixing belt 21 is tensioned to prevent slackening at the downstream position provided downstream from the center of the nip N, suppressing degradation of heating efficiency for heating the fixing belt 21 due to slack of the fixing belt 21, degradation of conveyance of the recording medium P, and creasing or wrinkling of the recording medium P.

Further, the heating member 22 is not expanded irregularly to have a greater outer circumference by spring-back of the heating member 22, but the reinforcement member 23, the screw 51, and the collar screw 52, which serve as a regulator or a holding member, define the direction H1 in which the downstream portion, that is, the free end 22E, of the heating member 22 is deformed at the downstream position provided downstream from the center of the nip N.

Further, the downstream portion, that is, the free end 22E, of the heating member 22 contacts the fixing belt 21 substantially uniformly at the downstream position provided downstream from the center of the nip N. Accordingly, the heating member 22 may not press against the inner circumferential surface of the fixing belt 21 with greater pressure locally, resulting in uniform temperature distribution of the whole fixing belt 21. Consequently, fluctuation of fixing performance on the fixed toner image T on the recording medium P may be suppressed.

FIGS. 6A, 7A, and 8A illustrate a schematic view showing a relation between the outer circumference of the heating member 22 and the inner circumference of the fixing belt 21. In FIGS. 6A, 7A, and 8A, the reinforcement member 23, the screw 51, and the collar screw 52, which hold the heating member 22, are omitted. FIGS. 6B, 7B, and 8B illustrate a plan view of the collar screw 52 and the elongated through-hole 22*b* seen in a direction A in FIG. 4. FIGS. 6B, 7B, and 8B correspond to FIGS. 6A, 7A, and 8A, respectively.

As illustrated in FIGS. 6A and 6B, when no load, that is, no external force, is applied to the heating member 22 held by the reinforcement member 23, the screw 51, and the collar screw 52, spring-back of the heating member 22 is applied to the free end 22E, not to the fixed end 22D, or greater spring-back of the heating member 22 is applied to the free end 22E compared to the fixed end 22D. Accordingly, the outer circumference of the free end 22E becomes greater than the outer circumference of the fixed end 22D. Specifically, spring-back acting in a direction H2 deforms (e.g., expands) the free end 22E into an elliptical shape.

Specifically, as illustrated in FIG. 6A, a virtual axis of the heating member 22, that is, a rotation axis of the fixing belt 21, substantially coincides with a virtual axis of an outer circumferential surface of the fixed end 22D of the heating member 22. When a distance D1 defines a distance from the virtual axis of the heating member 22 to the outer circumferential surface of the fixed end 22D and a distance D2 defines a distance from the virtual axis of the heating member 22 to the outer circumferential surface of the free end 22E, the distance D1 is smaller than the distance D2. When a distance H defines a distance from the virtual axis of the heating member 22 to the inner circumferential surface of the fixing bet 21, the distance D2 is greater than the distance H.

When the distance D1 is smaller than the distance D2 and the distance D2 is greater than the distance H as illustrated in FIG. 6A, the collar 52*a* of the collar screw 52 contacts one end, that is, a lower end, of the elongated through-hole 22*b* as illustrated in FIG. 6B. Accordingly, the collar 52*a* contacting the lower end of the elongated through-hole 22*b* regulates change of the outer circumference of the free end 22E of the heating member 22. In other words, the maximum outer circumference of the free end 22E does not exceed a predetermined size determined by the collar screw 52 and the elongated through-hole 22*b*.

As illustrated in FIGS. 7A and 7B, when the heating member 22 held by the reinforcement member 23, the screw 51, and the collar screw 52 is installed inside the fixing belt 21, an external force is applied in a direction H3 against spring-back of the heating member 22 to reduce the outer circumference of the free end 22E of the heating member 22. By contrast, the outer circumference of the fixed end 22D of the heating member 22 hardly changes. Accordingly, when a distance D3 defines a distance from the virtual axis of the heating member 22 to the outer circumferential surface of the free end 22E of the heating member 22, the distance D3 is smaller than the distance D2 illustrated in FIG. 6A. The distance D3 is also smaller than the distance H from the virtual axis of the heating member 22 to the inner circumferential surface of the fixing belt 21.

When the distance D3 is smaller than the distance D2 and the distance D3 is smaller than the distance H as illustrated in FIG. 7A, the collar 52*a* of the collar screw 52 contacts another end, that is, an upper end, of the elongated through-hole 22*b* as illustrated in FIG. 7B. Accordingly, the collar 52*a* contacting the upper end of the elongated through-hole 22*b* regulates change of the outer circumference of the free end 22E of the heating member 22. In other words, the minimum outer circumference of the free end 22E does not become smaller than a predetermined size determined by the collar screw 52 and the elongated through-hole 22*b*.

While the collar 52*a* contacts the upper end of the elongated through-hole 22*b* as illustrated in FIG. 7B, the heating member 22 is inserted into the loop formed by the fixing belt 21.

After the heating member 22 is inserted into the loop formed by the fixing belt 21, the external force applied in the direction H3 is released, thus finishing installation of the heating member 22 inside the fixing belt 21 of the fixing device 20.

As illustrated in FIGS. 8A and 8B, spring-back of the heating member 22 is applied to the free end 22E, not to the fixed end 22D, or greater spring-back of the heating member 22 is applied to the free end 22E compared to the fixed end 22D. Accordingly, the outer circumference of the free end 22E becomes greater than the outer circumference of the fixed end 22D. Specifically, spring-back acting in the direction H2 deforms (e.g., expands) the free end 22E into an elliptical shape.

Specifically, as illustrated in FIG. 8A, when a distance D4 defines a distance from the virtual axis of the heating member 22 to the outer circumferential surface of the free end 22E of the heating member 22, the distance D1 from the virtual axis of the heating member 22 to the outer circumferential surface of the fixed end 22D of the heating member 22 is smaller than the distance D4. The enlarged outer circumference of the free end 22E of the heating member 22 is restricted by the fixing belt 21 contacting the heating member 22. Accordingly, the distance D4, which is greater than the distance D1, equals to the distance H from the virtual axis of the heating member 22 to the inner circumferential surface of the fixing belt 21, which is smaller than the distance D2 depicted in FIG. 6A. When the distance D4 equals to the distance H as illustrated in FIG. 8A, the collar 52*a* of the collar screw 52 contacts neither the lower end nor the upper end of the elongated through-hole 22*b* as illustrated in FIG. 8B to perform the fixing process.

FIG. 8A illustrates the heating member 22 coinciding with the fixing belt 21 to emphasize a relation between the outer circumference of the free end 22E of the heating member 22 and the outer circumference of the fixing belt 21. However, when the heating member 22 is installed inside the fixing belt 21, the gap δ greater than 0 mm and not greater than 1 mm is provided between the fixing belt 21 and the heating member 22 at a position other than the nip N and the free end 22E of the heating member 22.

As described above, when the heating member 22 is installed inside the loop formed by the fixing belt 21, the outer circumference of the heating member 22 is changed to be smaller than an inner circumference of the fixing belt 21. Thus, the heating member 22 is installed inside the fixing belt 21 easily. Specifically, change in the outer circumference of the free end 22E of the heating member 22 is regulated as illustrated in FIGS. 6A and 6B so that the maximum outer circumference of the free end 22E does not exceed the predetermined size. Accordingly, even under conditions of no load, that is, when no external force is applied to the heating member 22, spring-back of the heating member 22 does not enlarge the outer circumference of the heating member 22 excessively. Thus, when the external force is applied to the heating member 22, the external force deforms the heating member 22 into the shape illustrated in FIG. 7A smoothly.

Further, change in the outer circumference of the free end 22E of the heating member 22 is regulated as illustrated in FIGS. 7A and 7B so that the minimum outer circumference of the free end 22E does not become smaller than the predetermined size. Accordingly, the external force does not press the heating member 22 excessively. In other words, the reinforcement member 23, the screw 51, and the collar screw 52 hold the heating member 22 in such a manner that change in the outer circumference of the free end 22E of the heating member 22 is within a predetermined amount. Thus, the heating member 22 is installed inside the fixing belt 21 easily.

As illustrated in FIGS. 8A and 8B, during the fixing process, the reinforcement member 23, the screw 51, and the collar screw 52 hold the heating member 22 to have a proper outer circumference. Thus, the outer circumference of the heating member 22 does not become substantially smaller than the inner circumference of the fixing belt 21. Consequently, the heating member 22 heats the fixing belt 21 with improved heating efficiency.

According to this exemplary embodiment, as illustrated in FIG. 4, the stationary member 26 includes holes or concave portions into which the screw 51 and the collar screw 52 protruding toward the nip N are inserted. Thus, the stationary member 26 contacts the reinforcement member 23 via the opening 22*a* of the heating member 22.

Figure 10:
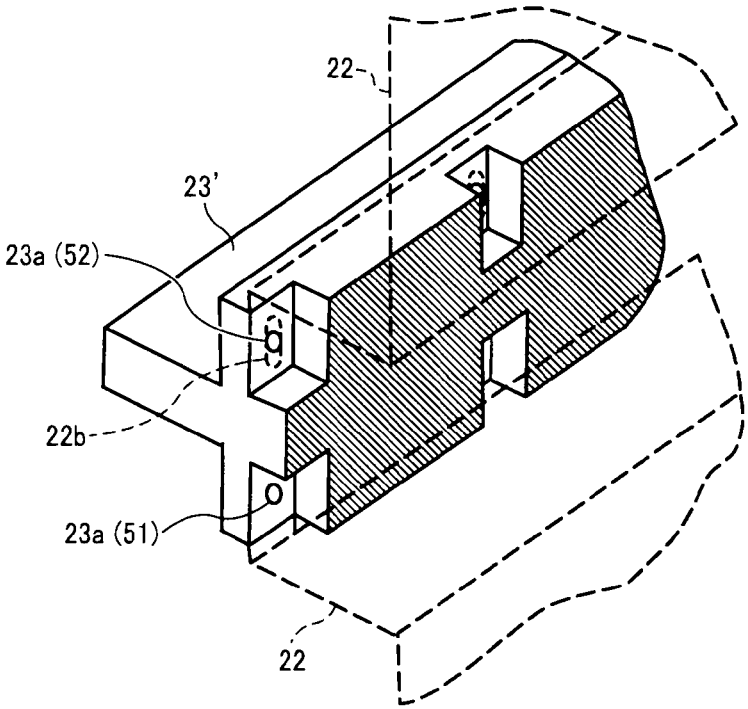
FIG. 10 is a perspective view illustrating a variation of a reinforcement member included in the fixing device shown in FIG. 4.

Alternatively, holes or concave portions may be provided in the reinforcement member 23 as illustrated in FIG. 10. FIG. 10 is a perspective view of a reinforcement member 23' including such holes or concave portions. As illustrated in FIG. 10, the reinforcement member 23' includes female screw portions 23*a*.

Each of the female screw portions 23*a* has a concave shape provided with a female screw that engages the screw 51 or the collar screw 52 inserted into the female screw portion 23*a*. The heating member 22 includes bent portions corresponding to a shape of the female screw portions 23*a* as illustrated by broken lines in FIG. 10. The stationary member 26 depicted in FIG. 4 contacts a hatched portion in FIG. 10 of the reinforcement member 23'.

According to this exemplary embodiment, as illustrated in FIG. 4, the screw 51 fixes the fixed end 22D of the heating member 22 to the reinforcement member 23, and the collar screw 52 holds the free end 22E of the heating member 22 with respect to the reinforcement member 23. Alternatively, the fixed end 22D and the free end 22E may be fixed to and held with respect to the reinforcement member 23 in other methods. For example, a rivet may fix the fixed end 22D of the heating member 22 to the reinforcement member 23, and a collar rivet may movably hold the free end 22E of the heating member 22 with respect to the reinforcement member 23.

As described above, according to this exemplary embodiment, the outer circumference of the heating member 22 is changeable with a force thereof, that is, spring-back of the heating member 22 and the external force. The regulator, that is, the reinforcement member 23, the screw 51, and the collar screw 52, regulates expansion of the heating member 22 by spring-back in such a manner that the outer circumference of the free end 22E of the heating member 22 is enlarged at the downstream position from the center of the nip N in the recording medium conveyance direction, suppressing uneven fixing of a toner image, improving heating efficiency for heating the fixing belt 21, facilitating installation of the heating member 22 inside the fixing belt 21, and suppressing slack of the fixing belt 21 at the downstream position from the center of the nip N in the recording medium conveyance direction.

According to this exemplary embodiment, the fixing device 20 includes the pressing roller 31 serving as a rotary pressing member. Alternatively, the fixing device 20 may include a pressing belt serving as a rotary pressing member to provide effects equivalent to the effects provided by the fixing device 20 including the pressing roller 31.

In the fixing device 20 according to this exemplary embodiment, the fixing belt 21 having a multi-layered structure is used as a belt member. Alternatively, an endless fixing film including polyimide, polyamide, fluorocarbon resin, and/or metal may be used as a belt member to provide effects equivalent to the effects provided by the fixing device 20 including the fixing belt 21.

According to this exemplary embodiment, when the heating member 22 is not installed in the fixing device 20, the external force is applied to the heating member 22 having spring-back as an elastic force to deform the heating member 22 elastically so as to change the outer circumference of the heating member 22. Alternatively, the fixing device 20 may include a heating member having a C-like shape with both ends disposed opposite each other, which does not generate spring-back. For example, when such heating member is not installed in the fixing device 20, the external force is applied to the heating member to deform the heating member elastically so as to change an outer circumference of the heating member. The reinforcement member 23, the screw 51, and the collar screw 52 hold the heating member in such a manner that one end of the heating member serves as a fixed end and another end of the heating member disposed opposite the one end via the opening 22*a* serves as a free end to provide effects equivalent to the effects provided by the heating member 22 that generates spring-back.

Figure 11:
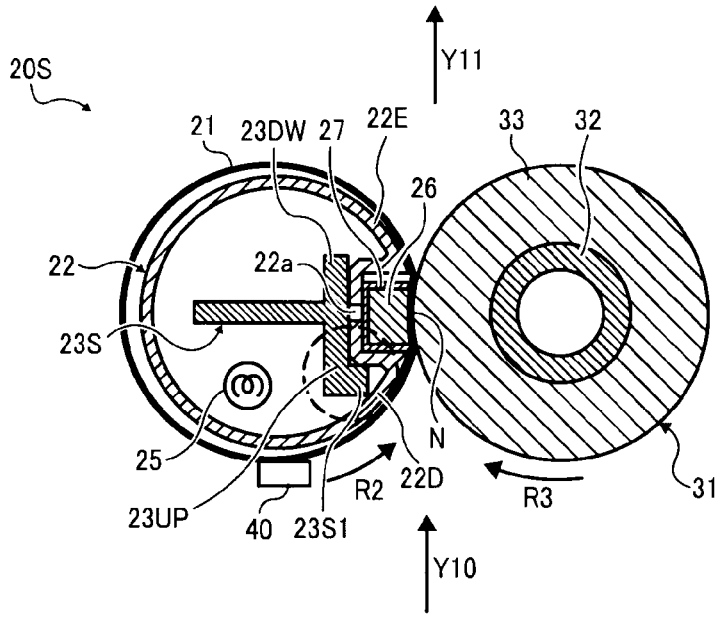
FIG. 11 is a schematic view of a fixing device according to another exemplary embodiment of the present invention.

Referring to FIG. 11, the following describes a fixing device 20S according to another exemplary embodiment. FIG. 11 is a schematic view of the fixing device 20S. As illustrated in FIG. 11, the fixing device 20S includes a reinforcement member 23S replacing the reinforcement member 23 depicted in FIG. 2. The reinforcement member 23S includes an upstream portion 23UP and a downstream portion 23DW. The upstream portion 23UP includes a bent portion 23S1. The other elements of the fixing device 20S are equivalent to the elements of the fixing device 20 depicted in FIG. 2. The reinforcement member 23S has a shape different from the shape of the reinforcement member 23.

Like the fixing device 20, the fixing device 20S includes the fixing belt 21 serving as a belt member, the stationary member 26, the C-like shaped heating member 22 including the opening 22*a*, the reinforcement member 23S serving as a holding member, the heat insulator 27, the heater 25, the pressing roller 31 serving as a rotary pressing member, and the temperature sensor 40. The fixing device 20S further includes a regulator, that is, the reinforcement member 23S, the screw 51, and the collar screw 52, for regulating expansion of the heating member 22 to enlarge the outer circumference (e.g., the outer radius) of the free end 22E of the heating member 22.

A second moment of area of the upstream portion 23UP of the reinforcement member 23S provided upstream from the center of the nip N in the recording medium conveyance direction or the rotation direction R2 of the fixing belt 21 to contact the fixed end 22D of the heating member 22 is greater than a second moment of area of the downstream portion 23DW of the reinforcement member 23S provided downstream from the center of the nip N to contact the free end 22E of the heating member 22. Specifically, the reinforcement member 23S is formed by adding the bent portion 23S1 to the T-shaped reinforcement member 23 depicted in FIG. 4 at the upstream portion 23UP of the reinforcement member 23S. In FIG. 11, the bent portion 23S1 is indicated by broken lines. Accordingly, the second moment of area of the upstream portion 23UP of the reinforcement member 23S which is greater than the second moment of area of the downstream portion 23DW of the reinforcement member 23S enhances a force of the reinforcement member 23S for fixing the fixed end 22D of the heating member 22 to the reinforcement member 23S so as to suppress deformation of the fixed end 22D of the heating member 22. By contrast, the downstream portion 23DW of the reinforcement member 23S needs not fix the free end 22E of the heating member 22 to the reinforcement member 23S, and therefore has the second moment of area smaller than the second moment of area of the upstream portion 23UP of the reinforcement member 23S.

As described above, as in the fixing device 20 depicted in FIG. 4, in the fixing device 20S, the outer circumference of the heating member 22 is changeable with a force thereof, that is, spring-back of the heating member 22 and the external force. The regulator, that is, the reinforcement member 23S, the screw 51, and the collar screw 52, regulates expansion of the heating member 22 by spring-back in such a manner that the outer circumference (e.g., the outer radius) of the free end 22E of the heating member 22 is enlarged at the downstream position from the center of the nip N in the recording medium conveyance direction, suppressing uneven fixing of a toner image, improving heating efficiency for heating the fixing belt 21, facilitating installation of the heating member 22 inside the fixing belt 21, and suppressing slack of the fixing belt 21 at the downstream position from the center of the nip N in the recording medium conveyance direction.

Figure 12:
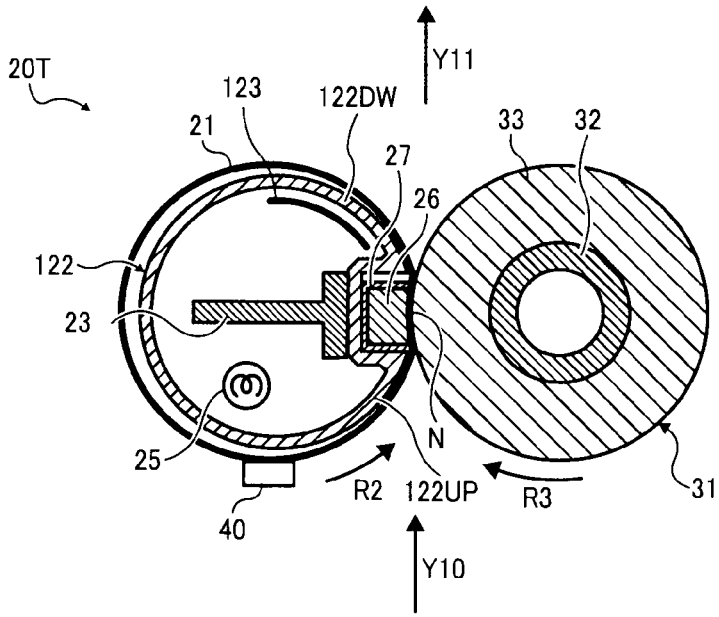
FIG. 12 is a schematic view of a fixing device according to yet another exemplary embodiment of the present invention.

Referring to FIG. 12, the following describes a fixing device 20T according to yet another exemplary embodiment. FIG. 12 is a schematic view of the fixing device 20T. As illustrated in FIG. 12, the fixing device 20T includes a heating member 122 replacing the heating member 22 depicted in FIG. 4 and an arc-shaped member 123 replacing the screw 51 and the collar screw 52 depicted in FIG. 4. The heating member 122 includes an upstream portion 122UP and a downstream portion 122DW. The other elements of the fixing device 20T are equivalent to the elements of the fixing device 20 depicted in FIG. 4. Instead of the reinforcement member 23, the screw 51, and the collar screw 52 of the fixing device 20 which serve as a regulator, in the fixing device 20T, the arc-shaped member 123 serves as a regulator for regulating expansion of the heating member 122 to enlarge an outer circumference (e.g., an outer radius) of the downstream portion 122DW of the heating member 122 provided downstream from the center of the nip N in the recording medium conveyance direction or the rotation direction R2 of the fixing belt 21.

Like the fixing device 20, the fixing device 20T includes the fixing belt 21 serving as a belt member, the stationary member 26, the heating member 122, the reinforcement member 23, the heat insulator 27, the heater 25, the pressing roller 31 serving as a rotary pressing member, and the temperature sensor 40.

Unlike the fixing device 20 including the C-like shaped heating member 22 having the opening 22*a*, the fixing device 22T includes the endless heating member 122 without the opening 22*a* in a circumferential surface portion. When the heating member 122 is not installed in the fixing device 22T, the heating member 122 is thermally expanded to change the outer circumference of the heating member 122 with heat. Specifically, when the heating member 122 is not installed in the fixing device 22T, the outer circumference of the heating member 122 is smaller than the inner circumference of the fixing belt 21 at room temperature, and is greater than the inner circumference of the fixing belt 21 by thermal expansion at high temperature during the fixing process. The heating member 122 includes a material or has a shape that facilitates such thermal expansion of the heating member 122.

The arc-shaped member 123 serves as a regulator for regulating expansion of the heating member 122 to enlarge the outer circumference of the downstream portion 122DW of the heating member 122 provided downstream from the center of the nip N in the recording medium conveyance direction to be greater than an outer circumference of other portion of the heating member 122. Specifically, the arc-shaped member 123 has a greater coefficient of thermal expansion than the heating member 122, and contacts an inner circumferential surface of the downstream portion 122DW of the heating member 122. With this structure, the arc-shaped member 123 is thermally expanded at high temperature during the fixing process, and presses against the heating member 122 to enlarge the outer circumference of the downstream portion 122DW of the heating member 122 at a position downstream from the center of the nip N. Accordingly, the heating member 122 is expanded into an elliptical shape, suppressing slack of the fixing belt 21 at the position downstream from the center of the nip N.

As described above, as in the fixing devices 20 and 20S depicted in FIGS. 4 and 11, respectively, in the fixing device 20T, the outer circumference of the heating member 122 is changeable with a force thereof, that is, thermal expansion of the heating member 122. The regulator, that is, the arc-shaped member 123, regulates expansion of the heating member 122 by pressing against the heating member 122 in such a manner that the outer circumference of the downstream portion 122DW of the heating member 122 is enlarged at the downstream position from the center of the nip N in the recording medium conveyance direction, suppressing uneven fixing of a toner image, improving heating efficiency for heating the fixing belt 21, facilitating installation of the heating member 122 inside the fixing belt 21, and suppressing slack of the fixing belt 21 at the downstream position from the center of the nip N in the recording medium conveyance direction.

Figure 13:
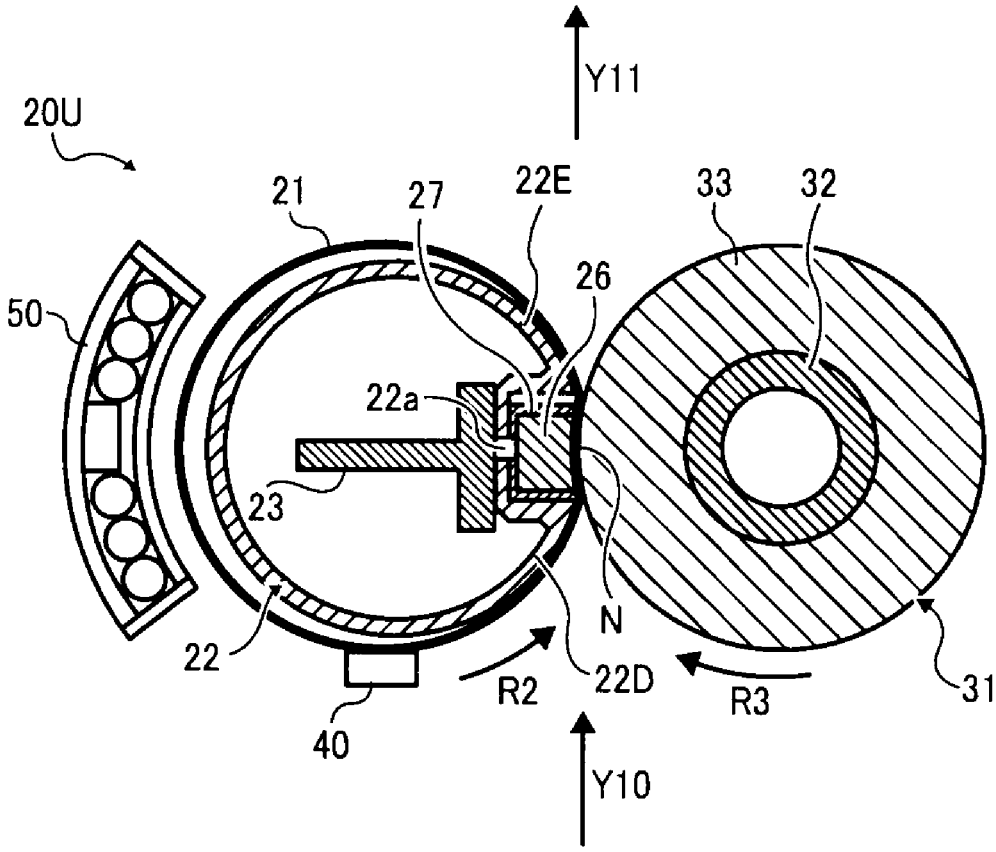
FIG. 13 is a schematic view of a fixing device according to yet another exemplary embodiment of the present invention.

Referring to FIG. 13, the following describes a fixing device 20U according to yet another exemplary embodiment. FIG. 13 is a schematic view of the fixing device 20U. As illustrated in FIG. 13, the fixing device 20U includes an induction heater 50 replacing the heater 25 depicted in FIG. 2. The other elements of the fixing device 20U are equivalent to the elements of the fixing device 20 depicted in FIG. 2. Unlike the fixing device 20 in which the heater 25 heats the heating member 22, in the fixing device 20U, the induction heater 50 heats the heating member 22 by electromagnetic induction.

Like the fixing device 20, the fixing device 20U includes the fixing belt 21 serving as a belt member, the stationary member 26, the C-like shaped heating member 22 including the opening 22*a*, the reinforcement member 23, the heat insulator 27, the pressing roller 31 serving as a rotary pressing member, and the temperature sensor 40. Like the fixing device 20, the fixing device 20U further includes a regulator, that is, the reinforcement member 23, the screw 51, and the collar screw 52, for regulating expansion of the heating member 22 to enlarge the outer circumference (e.g., the outer radius) of the free end 22E of the heating member 22 provided downstream from the center of the nip N in the recording medium conveyance direction or the rotation direction R2 of the fixing belt 21.

Unlike the fixing device 20 including the heater 25 for heating the heating member 22 by radiation heat, the fixing device 20U includes the induction heater 50 serving as a heater for heating the heating member 22 by electromagnetic induction.

The induction heater 50 includes an exciting coil, a core, and a coil guide. The exciting coil includes litz wires formed of bundled thin wires and extended in a width direction, that is, a long direction, of the induction heater 50 parallel to the axial direction of the fixing belt 21 to cover a part of the fixing belt 21. The coil guide includes a heat-resistant resin material and supports the exiting coil and the core. The core includes a semi-cylindrical member formed of a ferromagnet (e.g., ferrite) having a relative magnetic permeability in a range of from about 1,000 to about 3,000. The core includes a center core and a side core to generate magnetic fluxes toward the heating member 22 effectively. The core faces the exciting coil extending in the width direction of the induction heater 50.

The following describes operations of the fixing device 20U having the above-described structure. The induction heater 50 heats the fixing belt 21 rotating in the rotation direction R2 at a position at which the fixing belt 21 faces the induction heater 50. Specifically, a high-frequency alternating current is applied to the exciting coil to generate magnetic lines of force around the heating member 22 in such a manner that the magnetic lines of force are alternately switched back and forth. Accordingly, an eddy current generates on the surface of the heating member 22, and electric resistance of the heating member 22 generates Joule heat. The Joule heat heats the heating member 22 by electromagnetic induction, and the heated heating member 22 heats the fixing belt 21.

In order to heat the heating member 22 effectively by electromagnetic induction, the induction heater 50 may face the heating member 22 in an entire circumferential direction of the heating member 22. The heating member 22 may include nickel, stainless steel, iron, copper, cobalt, chrome, aluminum, gold, platinum, silver, tin, palladium, an alloy of a plurality of those metals, and/or the like.

As described above, like in the fixing devices 20, 20S, and 20T depicted in FIGS. 4, 11, and 12, respectively, in the fixing device 20U, the outer circumference of the heating member 22 is changeable with a force thereof, that is, spring-back of the heating member 22 and the external force. The regulator, that is, the reinforcement member 23, the screw 51, and the collar screw 52, regulates deformation (e.g., expansion) of the heating member 22 by spring-back in such a manner that the outer circumference (e.g., the outer radius) of the free end 22E of the heating member 22 is enlarged at the downstream position from the center of the nip N in the recording medium conveyance direction, suppressing uneven fixing of a toner image, improving heating efficiency for heating the fixing belt 21, facilitating installation of the heating member 22 inside the fixing belt 21, and suppressing slack of the fixing belt 21 at the downstream position from the center of the nip N in the recording medium conveyance direction.

In the fixing device 20U, the induction heater 50 heats the heating member 22 by electromagnetic induction. Alternatively, a resistance heat generator may heat the heating member 22. For example, the resistance heat generator may contact an inner circumferential surface of the heating member 22 partially or wholly. The resistance heat generator may be a sheet-type heat generator such as a ceramic heater, and a power source may be connected to both ends of the resistance heat generator. When an electric current is applied to the resistance heat generator, electric resistance of the resistance heat generator increases a temperature of the resistance heat generator. Accordingly, the resistance heat generator heats the heating member 22 contacted by the resistance heat generator. Consequently, the heated heating member 22 heats the fixing belt 21.

Alternatively, the heating member 22 may be a resistance heat generator. For example, the heating member 22 may be a thin resistance heat generator, and a power source may be connected to both ends of the resistance heat generator. When an electric current is applied to the resistance heat generator, electric resistance of the resistance heat generator increases the temperature of the resistance heat generator. Accordingly, the resistance heat generator heats the fixing belt 21.

Also when the fixing device 20U includes such resistance heat generator, the heating member 22 may change the outer circumference of the heating member 22 when the heating member 22 is not installed in the fixing device 20U. The regulator may regulate expansion of the heating member 22 to enlarge the outer circumference of the free end 22E of the heating member 22 at the downstream position provided downstream from the center of the nip N in the recording medium conveyance direction. Thus, the fixing device 20U provides effects equivalent to the effects provided by the fixing devices 20, 20S, and 20T.

According to the above-described exemplary embodiments, in a fixing device (e.g., the fixing device 20, 20S, 20T, or 20U depicted in FIG. 4, 11, 12, or 13, respectively), when a heating member (e.g., the heating member 22 depicted in FIG. 4, 11, or 13 or the heating member 122 depicted in FIG. 12) is not installed in the fixing device, the heating member changes the outer circumference thereof. A regulator (e.g., the reinforcement member 23 depicted in FIG. 4, 12, or 13, the reinforcement member 23' depicted in FIG. 10, or the reinforcement member 23S depicted in FIG. 11, the screw 51 depicted in FIG. 4, the collar screw 52 depicted in FIG. 4, and the arc-shaped member 123 depicted in FIG. 12) regulates deformation (e.g., expansion) of the heating member to enlarge the outer circumference of the heating member at the downstream position downstream from the center of the nip N in the recording medium conveyance direction or the rotation direction of a belt member (e.g., the fixing belt 21 depicted in FIG. 4, 11, 12, or 13). Accordingly, the fixing device can suppress uneven fixing of a toner image fixed on the recording medium, improve heating efficiency of the heating member to heat the belt member, facilitate installation of the heating member inside the loop formed by the belt member, and suppress slack of the belt member at the downstream position from the center of the nip N. The fixing device may be installed in an image forming apparatus (e.g., the image forming apparatus 1 depicted in FIG. 1).

According to the above-described exemplary embodiments, when a stationary member (e.g., the stationary member 26 depicted in FIG. 4, 11, 12, or 13) is "fixedly provided", the stationary member is held or supported without being rotated. Therefore, even when a biasing member such as a spring presses the stationary member against a rotary pressing member (e.g., the pressing roller 31 depicted in FIG. 4, 11, 12, or 13) at the nip N, for example, the stationary member is "fixedly provided" as long as the stationary member is held or supported without being rotated.

According to the above-described exemplary embodiments, the "outer radius" of the heating member is different from the outer radius generally defined as a diameter of the outer circumferential surface of the heating member, and therefore is defined as a radial distance from the virtual axis of the heating member to the outer circumferential surface of the heating member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

a fixing device, including a flexible endless belt member to rotate in a predetermined direction of rotation;

a rotary pressing member disposed opposite the belt member;

a stationary member provided inside a loop formed by the belt member and pressed against the rotary pressing member via the belt member to form a nip between the rotary pressing member and the belt member through which a recording medium bearing a toner image passes;

an expandable heating member provided inside the loop formed by the belt member to face an inner circumferential surface of the belt member to heat the belt member, the heating member comprising an upstream portion provided upstream from a center of the nip in the direction of rotation of the belt member and a downstream portion provided downstream from the center of the nip in the direction of rotation of the belt member; and a regulator to regulate expansion of the heating member, the regulator contacting the downstream portion of the heating member to expand the downstream portion of the heating member, wherein an amount of expansion of the downstream portion of the heating member is greater than an amount of expansion of the upstream portion of the heating member.

2. An image forming apparatus, comprising:

a fixing device, including a flexible endless belt member to rotate in a predetermined direction of rotation;

a rotary pressing member disposed opposite the belt member;

a stationary member provided inside a loop formed by the belt member and pressed against the rotary pressing member via the belt member to form a nip between the rotary pressing member and the belt member through which a recording medium bearing a toner image passes;

an expandable heating member provided inside the loop formed by the belt member to face an inner circumferential surface of the belt member to heat the belt member, the heating member comprising an upstream portion provided upstream from a center of the nip in the direction of rotation of the belt member and a downstream portion provided downstream from the center of the nip in the direction of rotation of the belt member; and a regulator to regulate expansion of the heating member, the regulator contacting the downstream portion of the heating member to expand the downstream portion of the heating member, wherein the heating member is elastically expandable, the heating member further comprising an opening facing the nip and extending in a long direction of the heating member, giving the heating member a C-shaped cross-section, wherein the upstream portion of the heating member comprises a fixed end adjacent to the opening, and the downstream portion of the heating member comprises a free end provided opposite the fixed end and adjacent to the opening, and wherein the regulator comprises a holding member to hold the fixed end and the free end of the heating member.

3. The image forming apparatus according to claim 2, wherein the holding member adjusts the free end of the heating member to change an outer circumference of the heating member by a predetermined amount.

4. The image forming apparatus according to claim 2, wherein an elongated through-hole is provided in the free end of the heating member, the holding member comprising:

a reinforcement member provided inside the heating member to contact the stationary member via the opening in the heating member to reinforce the stationary member;

a first fastener to fix the fixed end of the heating member to the reinforcement member; and a second fastener comprising a collar to engage the elongated through-hole of the heating member with play between the collar and the elongated through-hole to enable the free end of the heating member to move in the direction of rotation of the belt member.

5. The image forming apparatus according to claim 4, wherein the reinforcement member comprises:

an upstream portion contacting the upstream portion fixed end of the heating member; and a downstream portion contacting the downstream portion free end of the heating member, and wherein a second moment of area of the upstream portion of the reinforcement member is greater than a second moment of area of the downstream portion of the reinforcement member.

6. The image forming apparatus according to claim 2, wherein the elastically expandable heating member has a maximum outer circumference, which is the circumference of the heating member at rest in a free state free of compression, and a minimum outer circumference, which is the circumference of the heating member in use in a state of compression, the maximum outer circumference of the heating member being greater than an inner circumference of the belt member, and the minimum outer circumference of the heating member being smaller than the inner circumference of the belt member.

7. An image forming apparatus, comprising:

a fixing device, including a flexible endless belt member to rotate in a predetermined direction of rotation;

a rotary pressing member disposed opposite the belt member;

a stationary member provided inside a loop formed by the belt member and pressed against the rotary pressing member via the belt member to form a nip between the rotary pressing member and the belt member through which a recording medium bearing a toner image passes;

an expandable heating member provided inside the loop formed by the belt member to face an inner circumferential surface of the belt member to heat the belt member, the heating member comprising an upstream portion provided upstream from a center of the nip in the direction of rotation of the belt member and a downstream portion provided downstream from the center of the nip in the direction of rotation of the belt member; and a regulator to regulate expansion of the heating member, the regulator contacting the downstream portion of the heating member to expand the downstream portion of the heating member, wherein the regulator comprises an arc-shaped member to contact an inner circumferential surface of the downstream portion of the heating member, and wherein a coefficient of thermal expansion of the arc-shaped member is greater than a coefficient of thermal expansion of the heating member.

8. The image forming apparatus according to claim 1, wherein walls of the heating member have a thickness not greater than about 0.2 mm.

* * * * *